United States Patent [19]

Kim

[11] Patent Number: 5,074,174

[45] Date of Patent: Dec. 24, 1991

[54] SOCKET WRENCH

[75] Inventor: Kwang M. Kim, Koori, Rep. of Korea

[73] Assignee: Dae Sam Co., Ltd., Seoul, Rep. of Korea

[21] Appl. No.: 550,369

[22] Filed: Jul. 10, 1990

[30] Foreign Application Priority Data

Sep. 2, 1989 [KR] Rep. of Korea ..... 89-13012
May 23, 1990 [KR] Rep. of Korea ..... 90-6989

[51] Int. Cl.[5] ..... B25B 15/38

[52] U.S. Cl. ..... 81/185; 81/124.4; 81/121.1

[58] Field of Search ..... 81/185, 124.4, 121.1

[56] References Cited

U.S. PATENT DOCUMENTS

| | | | |
|---|---|---|---|
| 1,346,061 | 7/1920 | Rosenberg | 81/185 |
| 1,432,263 | 10/1922 | Schlutz . | |
| 1,456.290 | 5/1923 | Tell . | |
| 1,498,040 | 6/1924 | Johnson . | |
| 1,502,044 | 7/1924 | McCann . | |
| 1,513,332 | 10/1924 | McConnell . | |
| 1,997,948 | 4/1935 | Pearson | 81/185 |
| 2,337,368 | 12/1943 | Bohler | 81/185 |
| 2,502,587 | 4/1950 | Phipps | 81/185 |
| 2,580,247 | 5/1950 | Secondi et al. . | |
| 2,582,444 | 11/1950 | Lucht | 81/128 |
| 2,669,896 | 2/1954 | Clough | 81/128 |
| 2,701,489 | 9/1955 | Osborn | 81/53 |
| 2,743,641 | 5/1956 | Stricklett et al. | 81/163 |
| 2,814,227 | 11/1957 | Cushman . | |
| 2,850,931 | 9/1958 | Conway | 81/128 |
| 2,884,826 | 5/1959 | Bruhn | 81/128 |
| 3,102,732 | 9/1963 | Livermont | 279/2 |
| 3,253,486 | 5/1966 | Beck | 81/163 |
| 3,541,901 | 11/1970 | Murata | 81/165 |
| 3,724,299 | 4/1973 | Nelson | 81/128 |
| 4,136,588 | 1/1979 | Roder | 81/165 |
| 4,213,355 | 7/1980 | Colvin | 81/128 |

FOREIGN PATENT DOCUMENTS

| | | |
|---|---|---|
| 0194145 | 3/1923 | France . |
| 83-1343 | 8/1983 | Rep. of Korea . |
| 84-2675 | 12/1984 | Rep. of Korea . |

*Primary Examiner*—Frederick R. Schmidt
*Assistant Examiner*—Lawrence Cruz
*Attorney, Agent, or Firm*—Birch, Stewart, Kolasch & Birch

[57] ABSTRACT

A socket wrench which includes a body, a plurality of socket members telescopically assembled into the body, the socket members being movable in an upward or downward direction, an adjustment member mounted onto the body for adjusting the up-down movement of the socket members, and a ratchet member for controlling the rotational direction of the socket members relative to the body, whereby rapid selection of one of the socket members depending on the size of a specific bolt or nut can be obtained merely by controlling the adjustment member.

3 Claims, 4 Drawing Sheets

FIG. IA

SOCKET WRENCH

BACKGROUND OF THE INVENTION

1. Field of the Invention

The present invention relates to a socket wrench and more particularly, to an improved socket wrench including a plurality of socket members of varying sizes slidably assembled into the socket wrench in a telescopic manner so that upon utilizing the socket wrench, bolts or nuts having different sizes can be easily driven without any socket replacement.

2. Description of the Prior Art

Various types of conventional socket wrenches are well known in the art. Such socket wrenches have an adjustable members. However, such adjustable socket wrenches are expensive to manufacture, complicated in construction, and difficult in use. Such socket wrenches are shown in the U.S. Pat. Nos. 1,395,656, 1,432,263, 1,456,290, 1,502,044, 1,513,332, 2,743,641, 2,814,227, 3,253,486 and 3,541,901. Also, several types of conventional wrenches are utilized jaws so as to allow the user to adjust the jaws and then match the size of the socket to the size of bolts or nuts to be driven. However, such socket wrenches are not only cumbersome to carry out the adjustment operation but also complex in the overall structure. Therefore, it is difficult to fabricate such wrenches and thus it increases the manufacturing costs. Such socket wrenches are shown in the U.S. Pat. Nos. 2,582,444, 2,850,931, 2,884,826, 1,498,040, 2,580,247, 2,669,896, 2,701,489, 3,102,732, 3,724,299, 4,136,588 and 4,213,355.

The Korean Utility Model Publication No. 84-2675 discloses a socket wrench wherein several socket members are self-contained to enable the user to drive various sizes of bolts or nuts without any requirement for replacement of the socket members. However, the user first selects an appropriate socket member which corresponds to the size of a specific bolt or a nut. And then the user gets the selected socket member displace forward in an axial direction so that higher level of concentrative stresses are created in the course of driving operation since the socket member is utilized in an overhung condition. Also, in order to increase the strength of the socket member to a level enough to withstand those stresses, it is inevitable to increase wall thickness of the socket member and consequently rendering the socket member bulky and heavy. Therefore, this may be raised to a formidable problems in manufacturing and handling the socket wrench.

Further, the Korean Utility Model Publication No. 83-1343 discloses a socket wrench in which separate socket members are supplied independently so that the user may select a specific socket member of desired size and replace it for the previously assembled socket member, whenever it is necessary to drive bolts or nuts of different sizes. However, the socket wrench set forth above requires frequent replacement of the socket depending upon the size of bolts or nuts so that it is inconvenient for the user to handle it. In addition, separate socket members employed in the socket wrench have to be carried. Therefore, it is inconvenient to handle.

SUMMARY OF THE INVENTION

Accordingly, it is an object of the present invention to provide a socket wrench including a plurality of socket members slidably assembled in a telescopic manner, an adjustment member for governing the axial movement of the socket members, and a ratchet member for determining the rotational direction of the socket members for eliminating the requirement of separate sockets.

Another object of the present invention is to provide a socket wrench wherein socket members thereof are not overhung outwardly from the body of the socket wrench but overlapped to each other so that the strength of the socket members may not be injured even under the higher concentrative stresses. Thus the socket members can be minimized in thickness with the overall size and height of the socket wrench so that the user may carry conveniently and use the socket wrench.

A further object of the present invention is to provide an improved socket wrench which needs minimum member of elements having simple structures so as to enhance productivity while achieving cost down.

Briefly described, the present invention relates to a socket wrench which includes a body, a plurality of socket members telescopically assembled into the body, the socket members being movable in an upward or downward direction, an adjustment member mounted onto the body for adjusting the up-down movement of the socket members, and a ratchet member for controlling the rotational direction of the socket members relative to the body, whereby rapid selection of one of the socket members depending on the size of a specific bolt or nut can be obtained merely by controlling the adjustment member.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
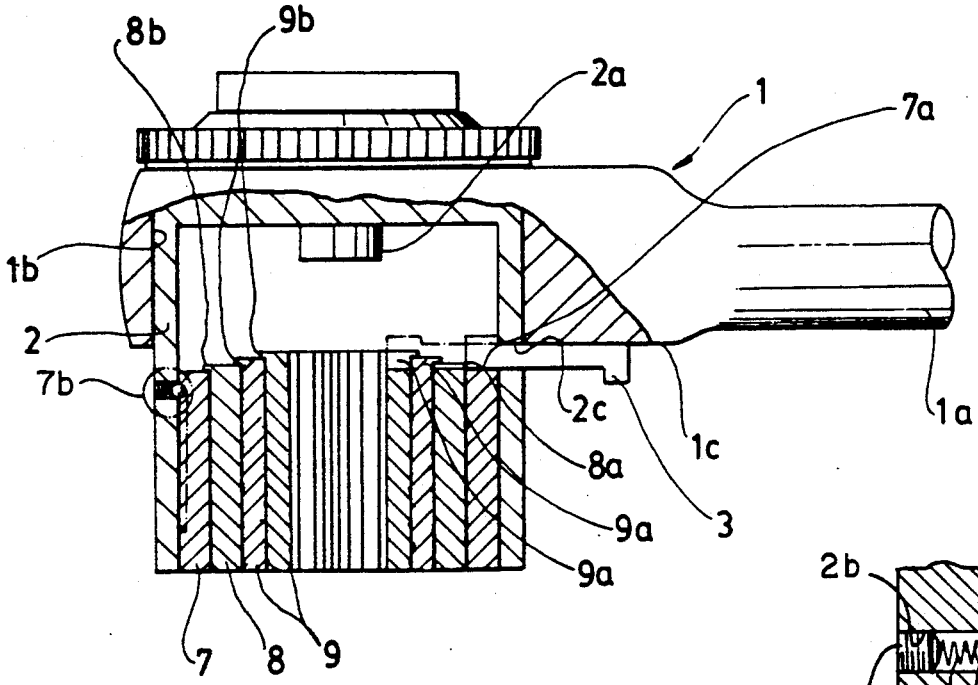
FIG. 1 is a side view of the socket wrench according to the present invention containing cut away portions in order to illustrate the construction of the socket wrench.
Figure 1:
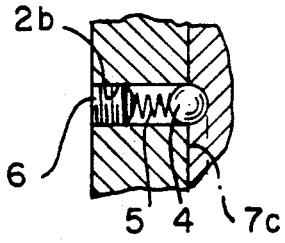
Figure 2:
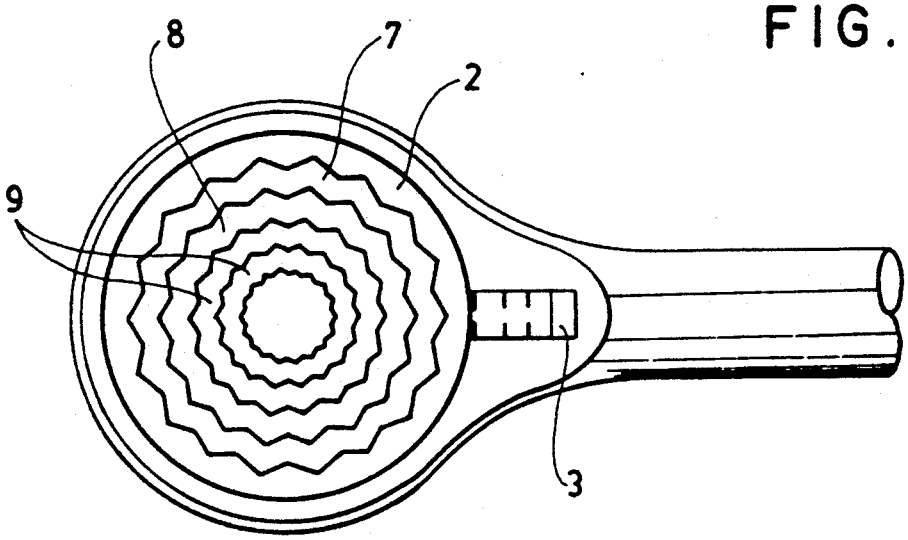
FIG 2. is a bottom view of the socket wrench according to the present invention.

Referring now in detail to the drawings for the purpose of illustrating preferred embodiments of the present invention, the socket wrench as shown in FIGS. 1 and 2 comprises a body 1 including a handle 1*a* integrally formed therewith, a recess 1*b* disposed on one side of the body 1 for securely holding a socket frame 2, and a bottom surface 1*c* is in the vicinity of the recess 1*b* for contacting with a knob 3. The socket frame 2 includes a lug 2*a* centrally disposed at the inner most surfaces thereof. The socket frame 2 also has an aperture 2b formed therethrough for retaining a ball 4 in a such a manner that the ball 4 is urged inwardly by a spring 5 held in the aperture 2b by means of a headless screw 6. A through-hole 2c diametrically opposed to the aperture 2b functions to guide the knob 3.

Within the socket frame 2, a plurality of socket members 7, 8, and 9 of different sizes are slidably assembled in a telescopic manner. Each of the socket members 7, 8, and 9 is provided with flanges 7b, 8b, and 9b at the upper end thereof and the flanges 7b, 8b, and 9b being grooved to provide knob paths 7a, 8a, and 9a. On the circumferential surface of the socket member 7 adjacent to the socket frame 2, an axial groove 7c is formed so that the ball 4 can be seated on the axial groove 7c.

The knob 3 is so calibrated as to indicate the amount of radial movement by its own scale as shown in FIG. 2. Accordingly, the operator can figure out what size of socket member is ready for use. Such knob 3 is designed to slide in a radial inward or outward direction along the way defined by the bottom surface 1c of the body 1, the through hole 2c, and the radial grooves 7a, 8a, and 9a.

Figure 3:
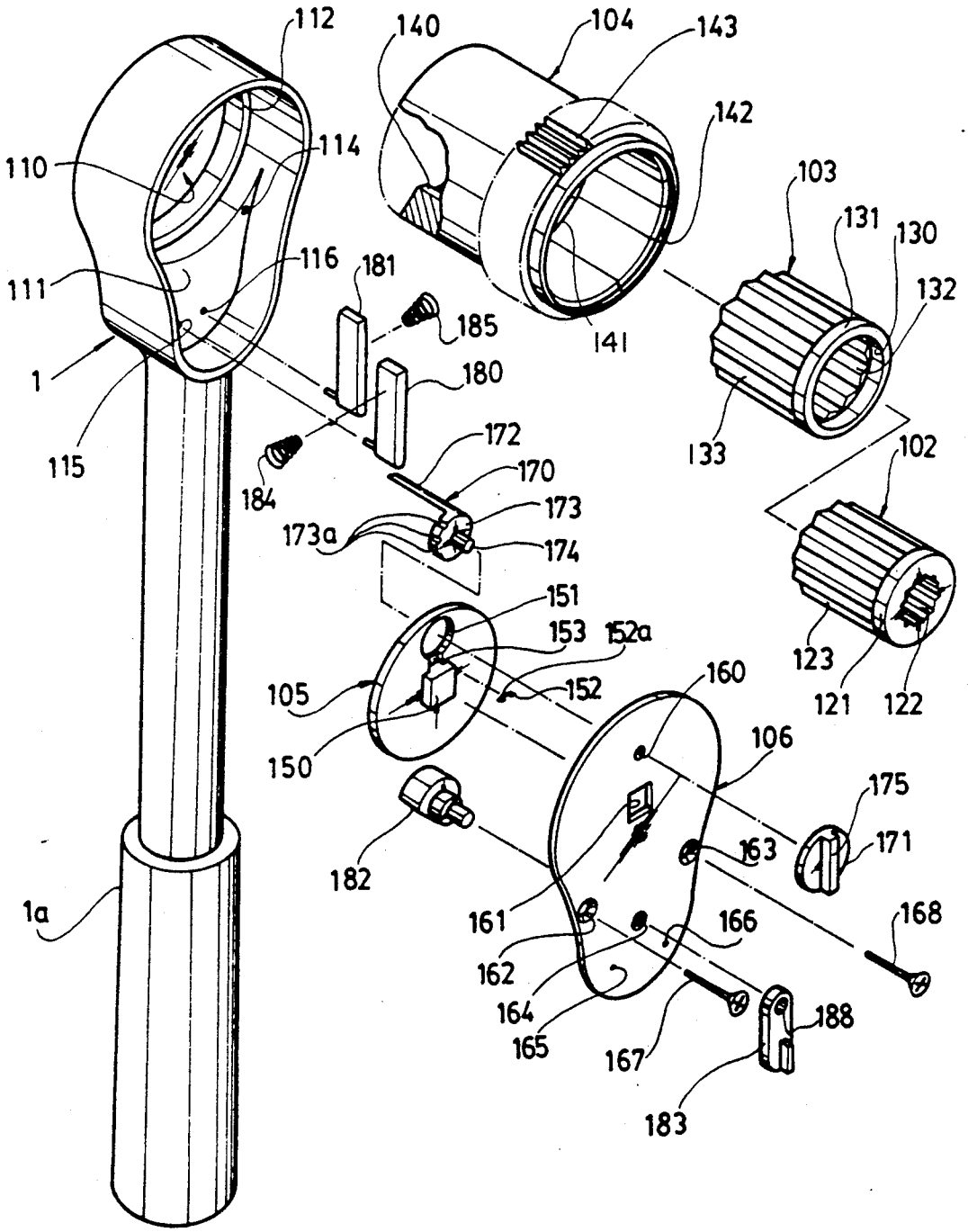
FIG. 3 is an exploded perspective view of a second embodiment of the socket wrench according to the present invention
Figure 4:
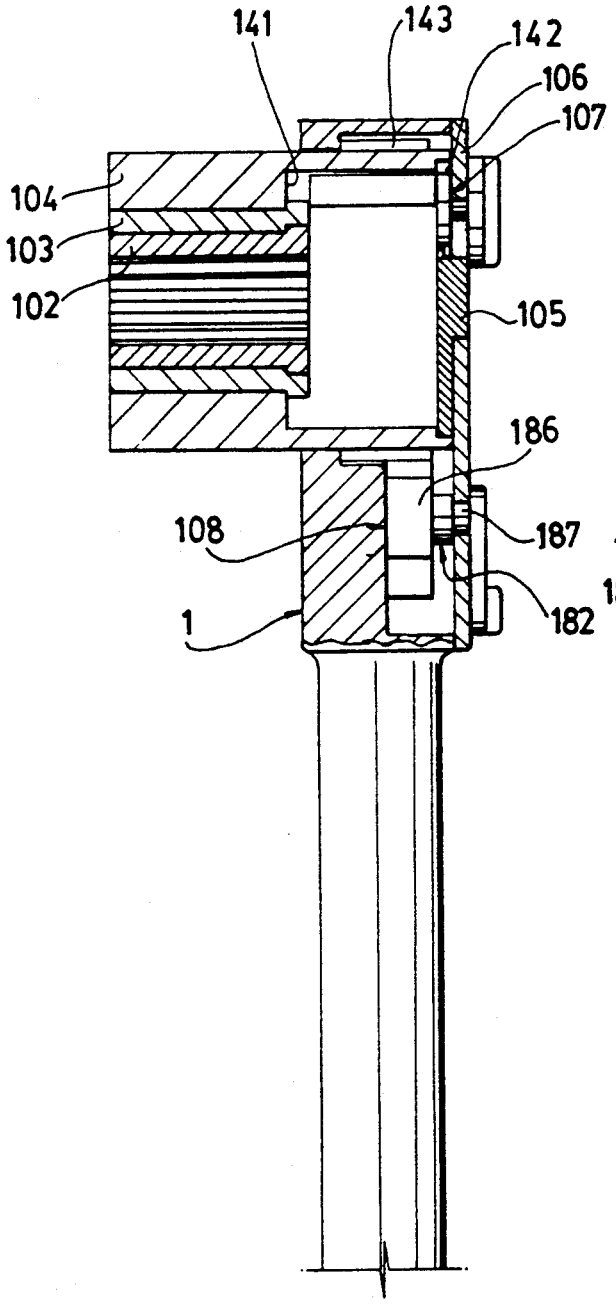
FIG. 4 is a side sectional view of the socket wrench of FIG. 3 according to the present invention.
Figure 5:
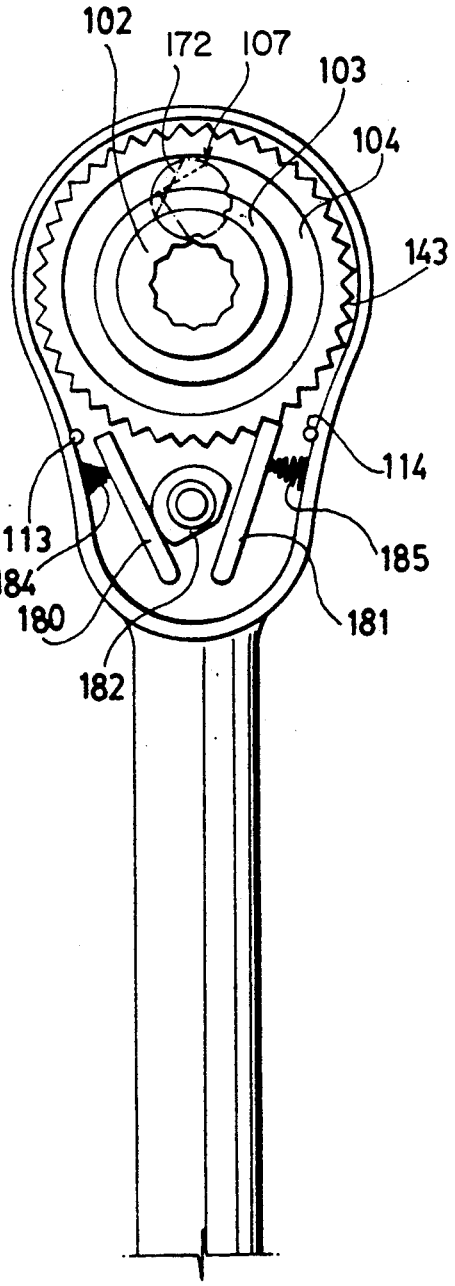
FIG. 5 is a top plan view of the socket wrench of FIG. 3 according to the present invention showing a top cover removed therefrom.

Referring to FIG. 3 through FIG. 5, there is shown a second embodiment of the socket wrench in accordance with the present invention. In this embodiment, the socket wrench comprises in combination the body 1 having the handle portion 1a adapted to be gripped by the operator, a plurality of socket members 102, 103, and 104 telescopically assembled to the body 1, the socket members 102, 103, and 104 being slidable in an axial direction, a cover plate 106 releasably attached to the upper most surface of the body 1, the top cover having a guide member 105 mounted on the inner surface thereof, an adjustment member 107 for preventing axial movement of at least one of the socket members 102, 103, and 104, and a ratchet member 108 for restricting the rotational direction of the body 1 relative to the socket member 108.

The body of the socket wrench includes an opening 110 through which a socket member 104 is rotatably inserted as shown in FIG. 3. An annular shoulder 112 is provided on the inner circumference of the opening 110 so that the socket member 104 can be seated on the shoulder 112 at its toothed portion 143. The body 1 further includes a recessed surface 111 having a pair of threaded holes 113 and 114 and a pair of pin holes 115 and 116 (FIG. 3).

As shown in FIG. 3, the socket members 102, 103, and 104 are so shaped and sized that they can be telescopically and slidably assembled one another. The smallest and intermediate socket members 102 and 104 include internal splines 122 and 132 disposed on their inner circumferences and external splines 123 and 133 disposed on their outer circumferences with stopper rims 121 and 131 disposed at one end of the respective socket members. The largest socket member 104 is provided with an internal spline 140 extending along a limited length of the inner circumference. The largest socket member 104 has a first shoulder 141 which can come into abutment with a stopper rim 131 and a second shoulder 142 on which a guide plate 105 is mounted to define a cavity within the socket member 104. A plurality of teeth 143 are disposed on the outer circumference of the socket member , which extend along a relatively short length. Each of the socket members 102, 103, and 104 are assembled into the body 1 of the wrench in the order of their size.

The guide plate 105 having a circular configuration is fixedly attached on one side of a cover plate 106. The guide plate 105 includes a rectangular lug 150 for fitting into the aperture 161 of the cover plate 106, a circular hole 151 sized to accommodate the adjustment member 107, and a groove 153 disposed between the rectangular lug 150 and the circular hole 151 for receiving an omega shaped spring 152 disposed therein. Such type of guide plate 105 is adapted to be seated on the second shoulder 142 of the largest socket member 104.

The cover plate 106 includes a first hole 160 into which the adjustment member 107 is rotatably inserted at its axle, a rectangular aperture 161 receiving the rectangular lug 150 of the guide plate 105, a pair of counter-sinked holes 162 and 163 through which screws 167 and 168 are threadably fixed to the body 1 of the wrench, a second hole 164 accommodating a portion of the ratchet member 108, and a pair of stopper pins 165 and 166.

The adjustment member 107 comprises in combination an actuation lever 170 and an adjustment knob 171. The actuation lever 170 includes an elongated leg 172 having a crescent shaped cross section, a cylindrical portion 173 having a number of axial groove 173a spaced apart circumferentially thereof, an upper axle 174 extending in an opposite direction relative to the leg 172. On the other hand, the adjustment knob 171 is provided with a protrusion extending across the upper surface of the knob 171. In their assembled position, the cylindrical portion 173 is inserted into the circular hole 151 of the guide plate 104 in a rotatable manner, the central axle 174 being rotatably held in the first hole 160 of the cover plate 106 with the upper end fixedly secured to the adjustment nob 171.

As shown in FIGS. 3, 4, and the free end of the elongated leg 172 moves on the upper surfaces of the socket members 102 and 103 and on the first shoulder 141 of the largest socket member 104 when the adjustment knob 171 is rotated by the operator. The omega shaped spring 152 is selectively engaged with one of the axial grooves 173a disposed at the central portion 152a thereof. Accordingly, the angular position of the elongated leg 172 is readily selected by the combined action of the spring 152 and axial grooves 173a.

The ratchet member 108 comprises a pair of pawls 180 and 181 pivotably held in the pin holes 115 and 116 respectively, a cam 182 rotatably inserted into the second hole 164 of the cover plate 106 and disposed between the pair of pawls 180 and 181, and a selection knob 183 which is placed on the exterior surface of the cover plate 106 and fixedly secured to the upper end of the cam 182. Each of the pawls 180 and 181 is baised toward each other by the respective compression springs 184 and 185. The cam 182 has a camming surface 186 which compresses either one of the pawls 180 and 181 and a central axle 187 pivoted to the cover plate 106. When the cam 182 rotates about its central axle 187 in the opposite direction by the actuation of the selection knob 183, the camming surface 186 can overcome the force exerted by the spring and compress either one of the pawls 180 and 181 so that the compressed pawl can be disengaged from the teeth 143 of the largest socket member 104, thereby determining the rotational direction of the wrench. Moreover, the selection knob 183 has a hole 188 for receiving the central axle 187 of the cam 182.

Figure 6:
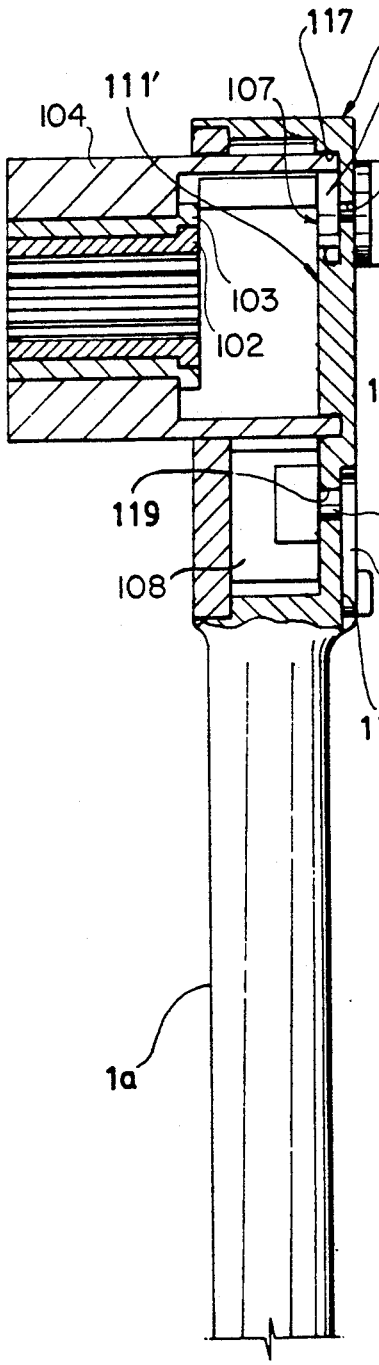
FIG. 6 is a side sectional view of a third embodiment of the socket wrench assembled by way of employing a bottom cover.
Figure 7:
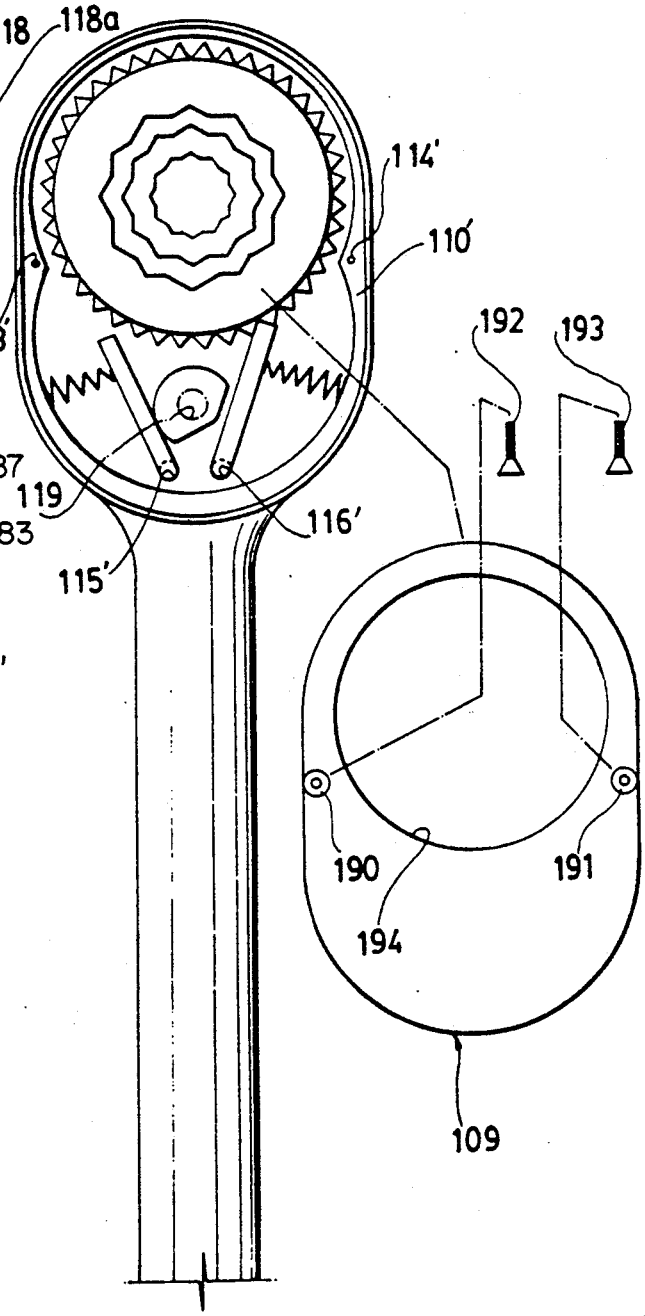
FIG. 7 is a bottom view of the socket wrench of FIG. 6 showing the bottom cover removed therefrom.

Referring to FIGS. 6 and 7, there is shown the third embodiment of the socket wrench wherein a body 1', of the socket wrench is opened at the lower surface thereof and a lower cover plate 109 is secured to the lower surface. In this embodiment, the socket members 102, 103, and 104, the adjustment member 107, and the ratchet member 108 are substantially identical in their configuration with those of the preceding embodiments.

The body 1', of the socket wrench consists of a handle portion 1a and a cavity 111' provided to accommodate the socket members 104 and the ratchet member 108. The body 1' further includes a guide wall 117 adapted to rotatably position the largest socket member 104, a circular recess 118 for receiving the adjustment member 107 in a rotatable condition, a first hole 118a through which the axle of the adjustment member 107 is inserted, a second hole 119 for journalling the central axle 187 of the cam, and a pair of pin holes 115' and 116' pivotally receiving the ratchet pawls. On the lower surface of the body 1', a shoulder 110' having a pair of threaded holes 113', and 114' is provided to allow a lower cover plate 109 to be seated thereon. The selection knob 183 of the ratchet member 108 is confined in the recess 112' to be able to carry out a limited range of angular movement.

The lower cover plate 109 is elliptically configured to be seated on the shoulder 110' of the body 1' and has a pair of holes 190 and 191 through which screws 192 and 193 can be inserted to mount the cover plate 109 on the body 1'. A larger aperture 194 is formed through the cover plate 109 to permit the socket members 104 to be inserted in a rotatable manner. In order to make an assembly, the socket members 102, 103, and 104, the adjustment member 107, and the ratchet member 108 are first assembled into the body 1'. After then the lower cover plate 109 is secured to the shoulder 110'.

The socket wrench in accordance with the present invention operates as follows:

When the operator intends to drive a bolt or a nut having a predetermined size by use of the socket wrench illustrated in FIG. 1 and 2, he has to displace the calibrated nob 3 to a position matching the size of the bolt or the nut and then locate the socket wrench on the bolt or the nut while maintaining the socket members 7, 8, and 9 in alignment with the bolt or the nut to be driven. By pressing the wrench against the bolt or the nut with a minor force, the socket members 7, 8, and 9 having smaller size than the bolt or the nut are displaced slidably and rearwardly. Therefore, the bolt or the nut can be inserted into one of the socket members 7, 8, and 9 as selected. When the driving operation is completed, the socket wrench is disengaged from the bolt or the nut, in response to which those socket members 7, 8, and 9 retreated by the bolt or the nut is reinstated due to the gravitational weight of the socket members 7, 8, and 9. The operation can be performed repeatedly to drive a variety of bolts or nuts.

In case where the socket frame 2 is in use, the knob 3 has to be radially outwardly pulled to its rearmost position. By placing the socket wrench onto and pressing it against the bolt or the nut with a minor force, the socket member 7 slides upwardly together with other socket members 8 and 9. The ball 4 engaged with the long groove 7c permits axial movement of the socket member 7 for preventing rotational movement thereof. Once the bolt or the nut is inserted into the socket frame 2, then it can be driven by the socket wrench.

When the driving operation is to be carried out by means of the socket wrench shown in FIG. 3 through FIG. 5 or in FIG. 6 or FIG. 7, the operator has to rotate the nob 171 of the adjustment member 107 to select a specific one of the socket members 102, 103, and 104 which is matching the size of the bolt or the nut to be driven.

More specifically, as shown in FIG. 5, the bottom surface of the elongated leg 172 can selectively traverses the upper surfaces of the socket members 102, 103, and 104 between three positions, i.e., the first position where the socket members 102 and 103 are axially locked so as to drive the smallest bolt or nut, the second position where only the socket member 102 is upwardly displaced so as to drive the bolt or nut having medium size, and the third position where both of the socket members 102 and 103 is upwardly displaced so as to drive the largest bolt or nut. In the course of rotating, the adjustment knob 171 to the positions set forth above, the spring 152 is selectively engaged with the axial groove 173a of the adjustment member 107 at its central portion 152a. It enables for the operator to perceive the selected socket member. Alternatively, the angular position of the knob 171 can be provided on the cover plate 106 or the body 1'. The selection knob 183 of the ratchet member 108 can be rotated in the opposite directions to restrict the rotational direction of the socket member 104.

When the knob 183 is rotated to a specific direction, the camming surface of the cam 182 compresses either one of the pawls 180 and 181 to cause it to be disengaged from the teeth 143 of the socket member 104, thereby making the socket member to rotate in a unilateral direction as selected.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A socket wrench for driving bolts, nuts, and the like, which comprises:

a body member having a handle portion, a plurality of socket members slidably disposed within said body member in an axial direction, an adjustment member for adjusting the axial movement of said socket members, said adjustment member including an actuation lever and an adjustment knob, said actuation lever having an elongated leg, a cylindrical portion, and a central axle, said adjustment knob having a protrusion, said leg having a crescent shaped cross-section, a ratchet member for controlling the rotational direction of said socket members, said body member including an opening for accommodating said socket members, a recessed surface holding said ratchet member, an annular shoulder disposed at the lower region of said opening, a pair of screw holes disposed on said recessed surface for receiving a pair of screws so as to attach the cover plate to the body member, and a pair of pin holed disposed on said recessed surface for pivotally receiving a pair of pawl pins, and intermediate and smallest socket members having flanges disposed at the upper end thereof and axial splines thereof disposed on their inner and outer circumferences, the largest socket member having axial splines on the inner circumference thereof, a first shoulder for seating said intermediate socket member thereon, a second shoulder and a plurality of teeth disposed on the outer circumference along a limited length.

2. The socket wrench of claim 1, further comprising a cover plate attached on the upper portion of said body member, a guide plate mounted on the lower surface of said cover plate, said guide plate having a rectangular protrusion disposed on the central region thereof, a circular opening for receiving said adjustment member, and a groove disposed between the rectangular protrusion and the circular opening for retaining an omega shaped spring therein, said cover plate including a hole formed so as to receive said adjustment member, a rectangular opening adapted to guide the rectangular protrusion of the guide plate, the pair of screw holes, a hole formed so as to hold the ratchet member, and the pair of stopper pins, whereby the cover plate is adapted to be secured to the body member by means of set screws.

3. The socket wrench of claim 1, wherein the body member includes a handle portion and a cavity provided to accommodate said socket members and said ratchet member, said body member also including a guide wall adapted to rotatably position the largest socket member, a circular recess receiving said adjustment member in a rotatable condition, a first hole supporting an axle of said adjustment member, a second hole for journalling a central axle of a cam, a pair of pin holes for pivotally receiving said pair of pawl pins, a shoulder provided to allow said lower cover plate to be seated thereon, said shoulder having the pair of threaded holes for receiving the pair of screws so as to attach the cover plate to the body member, and a recess disposed on an upper surface so as to limit the angular movement of said selection knob, and said cover plate being elliptically configured to be seated on said shoulder of said body member, having a pair of holes so that it can be secured to said body member by driving screws into said holes, and further including an aperture for receiving the largest socket member in a rotatable condition.

* * * * *